US005120429A

United States Patent [19]

Gupta et al.

[11] Patent Number: 5,120,429

[45] Date of Patent: Jun. 9, 1992

[54] CO-PROCESSING OF CARBONACEOUS SOLIDS AND PETROLEUM OIL

[75] Inventors: Avinash Gupta, Bloomfield; Marvin I. Greene, Oradell, both of N.J.

[73] Assignee: Lummus Crest Inc., Bloomfield, N.J.

[21] Appl. No.: 71,812

[22] Filed: Jul. 10, 1987

[51] Int. Cl.[5] ..... C10G 1/04; C10G 1/06

[52] U.S. Cl. ..... 208/403; 208/412; 208/413; 208/416; 208/417; 208/423; 208/429; 208/432; 208/434

[58] Field of Search ..... 208/403, 413, 416, 423, 208/432, 412, 417, 45, 434, 429

[56] References Cited

U.S. PATENT DOCUMENTS

| | | | |
|---|---|---|---|
| 3,583,900 | 6/1971 | Gatsis | 208/413 X |
| 4,045,329 | 8/1977 | Johanson et al. | 208/417 |
| 4,083,769 | 4/1978 | Hildebrand et al. | 208/413 X |
| 4,157,291 | 6/1979 | Paraskos et al. | 208/413 |
| 4,190,518 | 2/1980 | Giannetti et al. | 208/413 |
| 4,300,996 | 11/1981 | Kuehler | 208/413 |
| 4,330,389 | 5/1982 | Rosenthal et al. | 208/413 |
| 4,330,390 | 5/1982 | Rosenthal et al. | 208/413 |
| 4,354,920 | 10/1982 | Rosenthal et al. | 208/413 X |
| 4,376,093 | 3/1983 | Warzel | 208/432 X |
| 4,389,300 | 6/1983 | Mitchell | 208/432 X |
| 4,510,038 | 4/1985 | Kuehler | 208/434 |
| 4,522,700 | 6/1985 | Schindler | 208/434 X |
| 4,798,668 | 1/1989 | Ho | 208/429 X |

*Primary Examiner*—Anthony McFarlane

*Attorney, Agent, or Firm*—Elliot M. Olstein; Raymond J. Lillie

[57] ABSTRACT

In a process for producing distillates from coal by a first stage thermal liquefaction followed by a catalytic hydrogenation, liquefaction solvent is added at points spaced over the length of the thermal liquefaction heater.

Coal may be co-processed with petroleum oil by adding pre-hydrogenated oil to the first stage or unhydrogenated oil to the second stage.

16 Claims, 1 Drawing Sheet

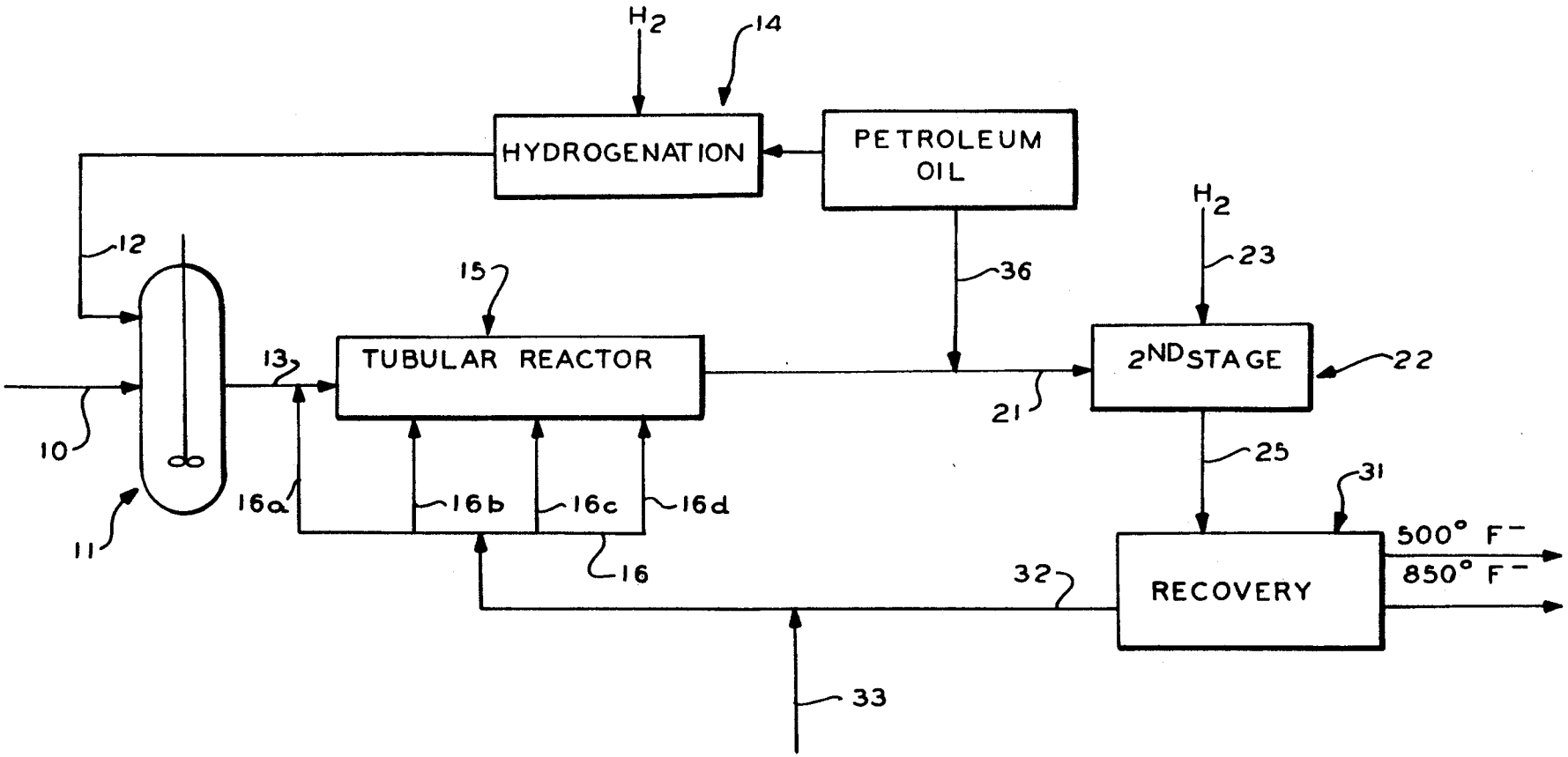
PETROLEUM OIL
HYDROGENATION
TUBULAR REACTOR
2ND STAGE
RECOVERY
H2
H2
500° F−
850° F−
10
11
12
13
14
15
16
16a
16b
16c
16d
21
22
23
25
31
32
33
36

CO-PROCESSING OF CARBONACEOUS SOLIDS AND PETROLEUM OIL

The Government of the United States of America has rights in this invention pursuant to Contract No. DE-AC22-84PC70042 awarded by the U.S. Department of Energy.

This invention relates to the processing of carbonaceous solids, and more particularly to the liquefaction of carbonaceous solids. Still more particularly, this invention relates to the co-processing of carbonaceous solids and a petroleum oil.

Carbonaceous solids, and in particular coal, have been liquefied in order to produce refinery like hydrocarbon liquids, and in particular distillates. In general, the liquefaction of carbonaceous solids, and in particular coal, involves a two step procedure, with the first step providing for liquefaction of the coal in the presence of a liquefaction solvent, and the second for upgrading of first stage liquefaction effluent to distillates by catalytic hydrogenation.

Similarly, heavy petroleum products such as crude oils and crude oil derivatives have been treated in order to upgrade such heavy petroleum products, to distillates. In general, difficulties have been encountered in upgrading such heavier petroleum materials as a result of the metals content, high residuum content, sulfur content, etc.

Accordingly, there is a need for an effective process for upgrading of both carbonaceous feedstocks and higher boiling or heavier petroleum feeds to refinery like hydrocarbon liquids.

In accordance with the present invention there is provided an improvement in a process for liquefying a carbonaceous solid in a two stage process wherein the first stage is a thermal liquefaction and the second stage is a catalytic hydrogenation.

In accordance with one aspect of the present invention, in the thermal liquefaction stage, liquefaction solvent is added in stages. More particularly, a carbonaceous solid is thermally liquefied in a thermal liquefaction heater (preferably a tubular heater) and liquefaction solvent is added to the heater over at least two points spaced over the length of the heater. In particular, in such addition, the amount of solvent added at any point is greater than the amount of solvent added at a previous point.

Thus, in accordance with this aspect of the present invention, a carbonaceous solid slurried in a liquid is introduced into a thermal liquefaction heater and liquefaction solvent is added to the pumpable slurry of carbonaceous solids during passage through the heater over at least two points spaced over the length of the heater.

The initial slurry may be formed from a liquefaction solvent identical to that added over the length of the heater or may be a coal derived liquid different than the liquefaction solvent added during passage through the heater or may be an extraneous liquid. As hereinafter indicated, the carbonaceous solid may be initially slurried in a hydrogentated heavy petroleum oil.

The total amount of liquefaction solvent added during passage of the slurried carbonaceous solid through the thermal liquefaction heater is sufficient to provide for liquefaction of the solid. In general, the liquefaction solvent is added in a total amount to provide at least 0.1 part of solvent per 1 part of coal, by weight. In most cases, the liquefaction solvent is provided in an amount which does not exceed 1 part of solvent per 1 part of carbonaceous solid, by weight. The number of points over which the solvent is introduced over the length of the heater will vary; however, solvent is introduced over at least two points and preferably over three or more points.

Although the present invention is not to be limited by any theoretical reasoning, it is believed that as liquefaction proceeds, the liquefaction solvent functions to accelerate the fragment stabilization route to oils by capping free radicals to prevent condensation reactions which lead to insoluble matter. The staged addition of liquefaction solvent is effected in a manner to correspond to the kinetics of the conversion of the carbonaceous matter to liquefied product which can reduce overall solvent requirements.

In accordance with a further aspect of the present invention, there is provided a process for the coprocessing of carbonaceous solids and a petroleum oil wherein a heavy petroleum oil is initially hydrogenated to increase the hydrogen content thereof, with the hydrogenated petroleum oil then being combined with a carbonaceous solid feedstock and subjected to a first stage thermal liquefaction in the presence of a liquefaction solvent to provide a combined liquefaction product which is then subjected to a catalytic hydrogentation in a second stage.

In accordance with another aspect of the present invention, there is provided a procedure for the co-processing of a carbonaceous solid and a heavy petroleum oil wherein the carbonaceous solid is thermally liquefied in a first stage in the presence of a liquefaction solvent, followed by catalytic hydrogenation of at least a portion of the thermal liquefaction product in a second stage to produce distillates, with a petroleum derived feed being hydrogenated in the second stage in conjunction with the liquefaction product.

In co-processing, the hydrogenated petroleum oil added to the first stage and/or the unhydrogenated petroleum oil added to the second stage may vary depending on process requirements. In general, the weight ratio of petroleum oil to coal ranges from about 1:10 to 10:1.

In a preferred embodiment, the addition of hydrogenation oil to the first stage is combined with staged addition of liquefaction solvent to the thermal heater. In such an embodiment, the hydrogenated petroleum oil is preferably employed in an amount which is at least sufficient to provide a pumpable slurry when combined with the carbonaceous solid feed.

In accordance with the various aspects of the present invention, the liquefaction process involves two stages, with the first stage being a thermal liquefaction, and the second stage being a catalytic hydrogenation to produce distillates.

In accordance with preferred embodiments the co-processing is combined with staged addition of liquefaction solvent, as hereinabove described.

In general, the first stage is operated at a temperature from about 700° F. to about 900° F., and most generally in the order from about 800° F. to 875° F. Contact times at such temperatures are generally in the order of from 0.5 minute to 40 minutes. In the first stage, the carbonaceous solid is liquefied in the presence of a liquefaction solvent at elevated pressures and in the presence of gaseous hydrogen. The liquefaction pressure is generally from 500 to 3,500 psig and hydrogen when used is generally added to the first stage in amounts of from 4,000 to 18,000 SCF per ton of coal. It is to be understood, however, that the conditions described are illustrative of those generally employed by the first stage.

The reaction contact time in the first stage is sufficient to effect liquefaction of the carbonaceous solid. The first stage liquefaction may be accomplished in a tubular heater, and if additional time is needed for effecting the liquefaction, a soaker may be used in conjunction with the heater to increase contact time.

All or a portion of the liquefaction product from the first stage is catalytically hydrogenated in a second stage. As known in the art, the first stage product includes unconverted solids derived from the feed, such as ash and such solids may be removed subsequent to the first stage and prior to the second stage with the solids being separated from the second stage product.

The second stage is operated to produce desired product, and in particular distillates, and to formulate liquefaction solvent for use in the first stage.

In general, the second stage is operated at a temperature from 650° F. to 890° F., and at a pressure in the order of from 1000 to 4000 psig. The second stage includes a hydrogenation catalyst of a type known in the art; for example, an oxide or sulfide of a Group VI and Group VIII metal.

In accordance with a preferred embodiment, the second stage hydrogenation is accomplished in an upflow ebullated or expanded bed, with such bed being of a type known in the art.

In accordance with the various aspects of the present invention wherein a petroleum oil is co-processed with the solid carbonaceous feed, in such a two stage procedure, as hereinabove indicated, the petroleum oil may be added to the second stage without prior hydrogenation, or in the alternative, petroleum oil may be hydrogenated and added to the first stage. Applicant has found that in a two stage process involving a thermal liquefaction stage and a catalytic hydrogenation stage, unhydrogenated petroleum oil should not be added to the first stage.

All or a portion of the liquefaction solvent requirements for the first stage may be provided by recovery of material from the second stage effluent which is comprised of 850° F.−liquid, as well as 850° F.+liquid. Thus, the material recovered from the second stage which is generally employed in formulating liquefaction solvent, is comprised of 500° F.+ material which includes materials which boil within the range of from 500° F. to 850° F. (850° F.− material), as well as the materials which boil above 850° F.+ materials)). The relative portions of 850° F.−material and 850° F.+ material present in the recycle solvent may be as disclosed, for example, in U.S. Pat. Nos. 4,547,282; or 4,545,890; or 4,544,476.

In accordance with the aspect of the present invention wherein a heavy oil derived from petroleum is hydrogenated and employed in the first liquefaction stage, such hydrogenation is operated at a severity which results in an increase in the hydrogen content of the fraction which has an initial boiling point of at least 650° F. and preferably at least 975° F. In such hydrogenation, the hydrogen content of such fraction is generally increased by at least 1% and preferably by at least 10% all by weight. In general, the hydrogen content is not increased by more than 30%.

The petroleum derived feed is hydrogenated at conditions to provide such a hydrogen content, with such hydrogenation generally being accomplished at a temperature in the order of from about 650° F. to 890° F. in the presence of a suitable hydrogenation catalyst which generally contains at least one hydrogenation component from Group VI-B or Group VIII, preferably supported on a suitable support such as alumina. The heavy petroleum oil may be hydrogenated in an expanded bed; however, the scope of the invention is not limited to such a procedure.

In general, hydrogen gas is employed in the hydrogenation in an amount to provide a hydrogen partial pressure of at least 30 atmospheres but less than 200 atmospheres. In general, the catalytic hydrogenation of petroleum oil is accomplished at a liquid hourly space velocity of at least 0.1 but less than 10.0.

It is to be understood, however, that such conditions are illustrative, and the selection of optimum conditions for accomplishing the hydrogenation of the petroleum oil, prior to combining such petroleum oil with a solid carbonaceous feed to be subjected to liquefaction, is deemed to be within the scope of those skilled in the art from the teachings herein.

The carbonaceous solid which may be treated in accordance with the various aspects of the present invention may be any one of a wide variety of such solids including, but not limited to various types of coal, lignite, peat, oil shale, tar sands, biomass and the like, with the preferred solid carbonaceous feed being coal.

The heavy petroleum oil which is treated in accordance with the present invention is one which has an initial boiling point in excess of about 600° F. As representative examples of such petroleum oils, there may be mentioned virgin vacuum residua; unconverted residue from the hydrotreatment of virgin vaccum residuum; unconverted residue from the fluid catalytic cracking of virgin residuum; unconverted residue from the heavy cycle oil from a fluid cat cracker; unconverted residue from the visbreaking of virgin residuum; asphalt fractions from a virgin residuum deasphalter; etc..

The invention will be further described with respect to the accompany drawing, wherein:

The drawing as a simplified schematic block flow diagram which illustrates the present invention.

Referring now to the drawing, a carbonaceous solid such as coal in line 10 is introduced into a slurry tank, schematically generally indicated as 11. The slurry tank 11 is also provided with a hydrogenated petroleum oil through line 12. The hydrogenated petroleum oil in line 12 has been previously hydrogenated in a hydrogenation zone 14 in order to provide a hydrogenated heavy petroleum fraction, as hereinabove described.

A pumpable slurry of carbonaceous solid in hydrogenated petroleum oil is withdrawn from slurry tank 11 through line 13 for introduction into a first stage thermal liquefaction. As particularly shown, the first stage thermal liquefaction is effected in a tubular reactor or heater, schematically generally indicated as 15.

Liquefaction solvent, obtained as hereinafter described, is introduced into the tubular reactor 15 over a plurality of points spaced over the length of the heater 15. As shown, the liquefaction solvent is introduced through line **16*a*, 16*b*, 16*c* and 16*d*, which are connected to a manifold 16. As hereinabove described, in a preferred embodiment, the amount of solvent introduced through line 16*d* exceeds the amount introduced through line 16*c*, the amount introduced through line 16*c* exceeds the amount introduced through line 16*b***;

and the amount introduced through line 16b exceeds the amount introduced through line 16a.

The first stage liquefaction is operated at conditions as hereinabove described in order to effect liquefaction of the carbonaceous material, and a first stage effluent is withdrawn through line 21 for introduction into the second stage which is a catalytic hydrogenation stage schematically indicated as 22. The second stage is provided with hydrogen through line 23.

The second stage catalytic hydrogenation is operated as hereinabove described in order to provide distillate product as well as liquefaction solvent. As hereinabove described, the second stage is preferably an expanded bed catalytic reactor; however, the scope of the invention is not limited to such reactor.

A second stage effluent is withdrawn through line 29, and introduced into a recovery zone; schematically generally indicated as 31. In the recovery zone 31, unconverted residue, if present, is separated. In addition, there is recovered a fraction which is comprised of material which boils up to about 500° F. to 650° F. as a lighter product and a distillate product which is comprised of material which boils in the order of from 500° F. to 850° F. In addition, there is recovered through line 32 a recycle liquefaction solvent which liquefaction solvent is comprised of both 850° F.− material and 850° F.+ material. Additional make-up solvent may be provided through line 33, and the liquefaction solvent is introduced into manifold 16 for staged introduction, as hereinabove described. As an alternative embodiment, instead of providing hydrogenated petroleum oil to the first stage, unhydrogenated petroleum oil may be provided to the second stage 23 through line 36. In such an embodiment, the coal would be slurried in tank 11 with either liquefaction solvent, provided as recycle solvent through line 32, or in the alternative, with an extraneous liquid.

The embodiment may also be modified by removing unconverted material prior to the second stage.

Similarly, although the embodiment has been described with respect to staged addition of liquefaction solvent, it is possible to provide hydrogenated petroleum oil to the first stage thermal liquefaction without using staged introduction of liquefaction solvent. In such a case, the liquefaction solvent, and hydrogenated petroleum oil could be combined in slurry tank 11. Similarly, although the staged introduction of liquefaction solvent for the first thermal liquefaction stage has been described with respect to a coprocessing procedure, it is possible to provide for staged introduction of liquefaction solvent into the first staage, without coprocessing of petroleum oil with a carbonaceous solid. In such an embodiment, the coal would be initially slurried in reycle liquefaction solvent provided through line 32, or in the alternative with a coal derived liquid (for example, from the first stage liquefaction product), or as a further alternative, by use of an extraneous liquid.

Thus, as should be apparent, the present invention is not limited to the embodiment specifically described with reference to the drawing.

The present invention will be further described with respect to following examples; however, the scope of the invention is not be limited thereby.

EXAMPLE

In the following Table, Case 1 represents addition of unhydrogenated petroleum oil to the first stage; Case 2 represents addition of hydrogenated petroleum oil to the first stage; and Case 3 represents addition of unhydrogenated petroleum oil to the second stage.

The unhydrogenated oil has hydrogen content of 9.75% based on 975° F.+ material.

As shown in Table, Cases 2 and 3 are superior to Case 1.

| Hydrotreatment Conditions For Pretreatment of Resid. | | | |
|---|---|---|---|
| (Case 2 only) | Case 1 | Case 2 | Case 3 |
| Temp., °C. | — | 401 | — |
| SV, SL/hr/L | — | 0.22 | 0 |
| Pressure, Atm | — | 136 | — |
| %975 + Converted | — | 44 | — |
| Yield of 975F + Pitch, Bbl/bbl 975 + Feed | — | 0.265 | — |
| Hydrogen content of 975 + Pitch, % | — | 11.40 | — |
| Feedstock: | | | |
| % Coal (Ill. No. 6) | 40 | 40 | 40 |
| % 975F + Pitch | 30 | 30 | 30 |
| % Cold Lake ATM. Resid. | 30 | 30 | 30 |
| SCT Conditions (First Stage) | | | |
| Temperature, °C. | 443 | 443 | 443 |
| Pressure, Atm. | 136 | 136 | 136 |
| Contact Time, Min. | 10 | 10 | 10 |
| Catalytic Stage Conditions (Second Stage) | | | |
| Temperature, °C. | 410 | 410 | 410 |
| Pressure, Atm. | 136 | 136 | 136 |
| Contact Time, Min. | 60 | 60 | 60 |
| Catalyst | Shell | 324M | Ni/Mo/$Al_2O_3$ |
| Co-Processing Performance | | | |
| % QI in Catalytic Stage Product | 7.9 | 4.6 | 3.2 |
| % TI in Catalytic Stage Product | 21.1 | 7.0 | 8.7 |
| Preasphaltenes | | | |
| Yield, Kg/100 kg Coal | 34.7 | 6.1 | 15.0 |
| Oil Yields, kg/100 kg Coal | 52.1 | 61.5 | 75.0 |
| Co-Processing Performance index (CPI) | 62.2 | 91.6 | 83.0 |

CPI = MAF Coal Conversion × 0.25 + Oil + Asphaltenes × 0.75
Oil + Ashaltenes + Preasphaltenes The present invention is particularly advantageous in that in a cola liquefaction procedure, with or without co-processing, solvent requirements can be reduced by staged addition of solvent. In addition, by maintaining a proper balance of donor solvent concentration as the reaction proceeds along the length of the reactor in the first stage, there can be obtained an improvement in coal conversion. The improvement in the first stage operation also improves the second stage, resulting in improvement of distillate yeilds and lower catalyst replacement rates. The present invention provides for improved co-processing by utilizing the petroleum feed in a manner such that unhydrogenated petroleum feed is not introduced into the first stage. These and other advantages should be apparent to those skilled in the art.

Numerous modifications and variations of the present invention are possible in light of the above teachings, and therefore, within the scope of the appended claims, the invention may be practiced otherwise than has been particularly described.

what is claimed is:

1. In a process for liquefying a carbonaceous solid in a thermal liquefaction heater in a first stage thermal liquefaction in the presence of a liquefaction solvent, followed by a second stage catalyic hydrogenation wherein liquefaction solvent is recovered from the second stage for use in the first stage, the improvement comprising:

introducing a liquefaction solvent to the first stage liquefaction heater, said liquefaction solvent being introduced in at least two separate portions over two points spaced over the length of the heater.

2. The process of claim 1 wherein the amount of liquefaction solvent added at each subsequent point is greater than the amount added at a previous point.

3. The process of claim 2 wherein liquefaction solvent is added in a total amount of from 0.1 to 1.0 parts of solvent per 1 part of carbonaceous solid.

4. The process of claim 1 wherein the carbonaceous solid is slurred in a hydrogenated heavy petroleum oil prior to introduction into the thermal liquefaction heater.

5. The process of claim 4 wherein the heavy petroleum oil is hydrogenated to increase the hydrogen content of the 650° F.+ fraction by at least 1 weight percent.

6. The process of claim 5 wherein the thermal liquefaction is effected at a temperature of from 700° F. to 900° F.

7. The process of claim 6 wherein the amount of liquefaction solvent added at each subsequent point is greater than the amount added at a previous point.

8. The process of claim 7 wherein the liquefaction solvent is added in a total amount of from 0.1 to 1.0 parts of solvent per 1 part od carbonaceous solid.

9. A process for the liquefaction of a carbonaceous solid, comprising:

liquefying a carbonaceous solid in a liquefaction solvent in a first stage thermal liquefaction;

catalytically hydrogenating at least a portion of a liquefaction product from the first stage in a second stage to upgrade liquefaction product and product distillates; and introducing as an external fresh feed a petroleum derived feed into the second stage for hydrogenation in conjunction with liquefaction product.

10. The process of claim 9 wherein the petroleum derived feed has at least 25 volume percent thereof boiling above about 900° F.

11. The process of claim 10 wherein at least a portion of the liquefaction solvent employed in the first stage is 500° F+ material derived from the second stage.

12. The process of claim 11 wherein the thermal liquefaction is effected in a thermal liquefaction heater and liquefaction solvent employed in the first stage is added over at least two points spaced over the length of the heater.

13. In a process for the liquefaction of a carbonaceous solid in a first stage thermal liquefaction in the presence of a thermal liquefaction solvent, followed by a second stage catalytic hydrogenation, the improvement comprising:

hydrogenating a heavy petroleum oil to increase the hydrogen content of the 650° F.+ fraction thereof by a least 10 weight percent and employing the hydrogenated heavy petroleum oil as an external fresh feed in the first stage thermal liquefaction, and wherein the thermal liquefaction is effected in a thermal liquefaction heater and liquefaction solvent employed in the first stage is added over at least two points spaced over the length of the heater.

14. The process of claim 13 wherein the amount of liquefaction solvent added at each subsequent point is greater than the amount added at a previous point.

15. The process of claim 14 wherein liquefaction solvent is added in a total amount of from 0.1 to 1.0 parts of solvent per 1 part of carbonaceous solid.

16. The process of claim 13 wherein the petroleum oil is catalytically hydrogenated at a temperature of from 650° F. to 890° F.

* * * * *